US007458699B2

(12) United States Patent
Whiteside et al.

(10) Patent No.: US 7,458,699 B2
(45) Date of Patent: Dec. 2, 2008

(54) BALL GLOVE HAVING IMPACT DETECTION AND VISIBLE ANNUNCIATION

(75) Inventors: Dennis Karl Whiteside, St. Charles, MO (US); Jason Michael McCartney, St. Louis, MO (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 211 days.

(21) Appl. No.: 11/368,200

(22) Filed: Mar. 3, 2006

(65) Prior Publication Data

US 2007/0206373 A1 Sep. 6, 2007

(51) Int. Cl.
*F21V 21/08* (2006.01)
*A63B 71/14* (2006.01)

(52) U.S. Cl. ..... 362/103; 362/276; 362/802; 2/161.1

(58) Field of Classification Search ..... 362/103, 362/276, 802, 570; 2/160, 161.1; 340/540, 340/568.6; 446/26, 485; 273/460
See application file for complete search history.

(56) References Cited

U.S. PATENT DOCUMENTS

| | | | | |
|---|---|---|---|---|
| 1,199,710 | A | 9/1916 | Newton | |
| 1,215,389 | A | 2/1917 | Lauray | |
| 1,230,943 | A | 6/1917 | Sundh | |
| 3,638,011 | A | 1/1972 | Bain et al. | |
| 4,346,481 | A | 8/1982 | Latina | |
| 4,453,272 | A | 6/1984 | Miyake et al. | |
| 4,513,450 | A | 4/1985 | Aoko | |
| 4,853,975 | A | 8/1989 | Clevenhagen | |
| 5,118,910 | A * | 6/1992 | Duhon et al. | 200/86 R |
| 5,177,467 | A | 1/1993 | Chung-Piao | |
| 5,321,853 | A | 6/1994 | Onley | |
| 5,377,996 | A * | 1/1995 | Shure | 273/330 |
| 5,406,724 | A * | 4/1995 | Lin | 36/137 |
| 5,424,922 | A | 6/1995 | Wise | |
| 5,444,462 | A | 8/1995 | Wambach | |
| 5,535,105 | A | 7/1996 | Koenen Myers et al. | |
| 5,580,154 | A | 12/1996 | Coulter et al. | |
| 5,816,676 | A | 10/1998 | Koenen Myers et al. | |
| 5,987,779 | A | 11/1999 | Litchfield et al. | |
| 6,006,357 | A | 12/1999 | Mead | |
| 6,012,822 | A | 1/2000 | Robinson | |
| 6,079,269 | A | 6/2000 | Dilz, Jr. | |
| D449,714 | S | 10/2001 | Aoki | |
| 6,592,235 | B1 | 7/2003 | Mayo | |
| 6,709,142 | B2 | 3/2004 | Gyori | |
| 6,788,201 | B2 * | 9/2004 | Chen et al. | 340/540 |
| 6,892,397 | B2 | 5/2005 | Raz et al. | |
| 2001/0004808 | A1 | 6/2001 | Hurwitz | |
| 2001/0024364 | A1 | 9/2001 | Hurwitz | |
| 2004/0047145 | A1 * | 3/2004 | Koren | 362/101 |
| 2006/0007669 | A1 | 1/2006 | Blackburn | |
| 2006/0007670 | A1 | 1/2006 | Chien | |
| 2006/0089214 | A1 * | 4/2006 | Cracolici | 473/451 |

* cited by examiner

*Primary Examiner*—Ali Alavi
(74) *Attorney, Agent, or Firm*—Mark C. Young; Stinson Morrison Hecker LLP

(57) ABSTRACT

A ball glove includes impact detection and annunciation circuitry for detecting an impact event, such as contact of a caught ball with the glove. Upon detection of an impact, annunciation circuitry provides a visible light signal, such as flashing a sequence of lights located in the web portion of the glove. An associated method of use is also provided.

12 Claims, 6 Drawing Sheets

BALL GLOVE HAVING IMPACT DETECTION AND VISIBLE ANNUNCIATION

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

1. Field of the Invention

The present invention relates to sporting goods equipment, and more particularly to baseball and softball gloves having impact detection and annunciation capability.

2. Description of Related Art

The sports of baseball and softball each require the use of specifically configured gloves, designed to facilitate catching a ball and provide protection to the hand of the wearer. These ball gloves are an integral part of the sports, as they allow the players to stop and catch balls moving at very high speeds without injuring themselves. Virtually any baseball or softball game, whether professional, little-league, or a recreational pick-up game, will involve players using ball gloves.

In leagues geared towards younger players, and in recreational leagues and pick-up games, players often use variations of equipment used by professional players. For example, younger players will, of course, use ball gloves that are smaller in size than regulation professional equipment. Likewise, younger players often prefer brightly colored equipment, such as neon-colored ball gloves. Some of these variations are merely aesthetic, and appeal to a younger player's sense of fashion. Other variations, such as fluorescent or brightly colored gloves, are more practical, and can help identify particular players, or can help a player locate their equipment easily. Thus, beyond being whimsical, these various configurations can also serve to assist in certain aspects of the game, and keep or attract interest in the game.

Of the available variations of ball gloves available, most are static, non-interactive variations. Brightly colored gloves, for example, don't change or vary based on events occurring in the game, or react to players' actions or movements. Ball gloves capable of reacting to movements and events within the game would increase the players' interest in the game, and add to the entertainment value of the game.

Thus, it can be seen that there remains a need in the art for a ball glove that can detect and annunciate specific events as they occur in the game in order to provide additional entertainment value to the game, and to keep a younger player's interest in the game.

BRIEF SUMMARY OF THE INVENTION

The present invention is directed to baseball and softball gloves having impact detection and annunciation capabilities. An impact detecting sensor is affixed to the glove to detect the impact of a caught ball. Upon detection of an impact event, a visible signal is triggered to indicate that an impact has occurred. For example, a series of light-emitting diodes mounted in the web of the ball glove may be sequentially activated to provide a luminary indication that a ball has been caught.

In an exemplary embodiment of the present invention, a lighted ball glove comprises a glove portion configured to fit a wearer's hand, having a thumb portion, a finger portion, and a web extending between the thumb and finger portions. A translucent lens, formed as a flexible tube, is affixed to the web portion so that the lens is visible from both the front and the rear of the glove. Annunciation circuitry, including a plurality of super-bright, colored, light-emitting diodes, is affixed within the glove, with the light-emitting diodes mounted to the translucent lens in the web portion. Impact detection circuitry, comprising an acceleration sensor, is affixed within the palm of the glove to detect the impact of a ball caught in the glove.

Upon detection of an impact to the glove, such as a ball striking the palm portion of the glove, the impact detection circuitry generates a trigger signal that is transmitted to the annunciation circuitry. On receiving the trigger signal, the annunciation circuitry sequentially activates the light-emitting diodes in a predetermined pattern, for a predetermined amount of time, thus announcing the impact event. The activated light-emitting diodes in the translucent lens emanate a light pattern that is visible from both the front and rear of the glove. Thus, the impact of catching a ball with the glove triggers a light show in the web of the glove, providing an indication to the players and observers that the ball has hit the glove.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail in the following detailed description of the invention with reference to the accompanying drawings that form a part hereof, in which.

DETAILED DESCRIPTION OF EXEMPLARY EMBODIMENTS

A lighted ball glove having impact detection and visible annunciation in accordance with an exemplary embodiment of the present invention is depicted in FIGS. 1 through 6. While the invention will be described in detail herein below with reference to this exemplary embodiment, it should be understood that the invention is not limited to the specific configuration shown in this embodiment. Rather, one skilled in the art will appreciate that a variety of configurations may be implemented in accordance with the present invention. It should also be apparent that while the exemplary embodiment refers to a ball glove, the present invention is adaptable to various embodiments of ball gloves, such as baseball gloves, fielder's gloves, catcher's mitts, first basemen's mitts, and softball gloves. All references to "glove" or "ball glove" as used herein shall be construed to encompass these and other configurations of ball gloves.

Exemplary Embodiment

Figure 1:
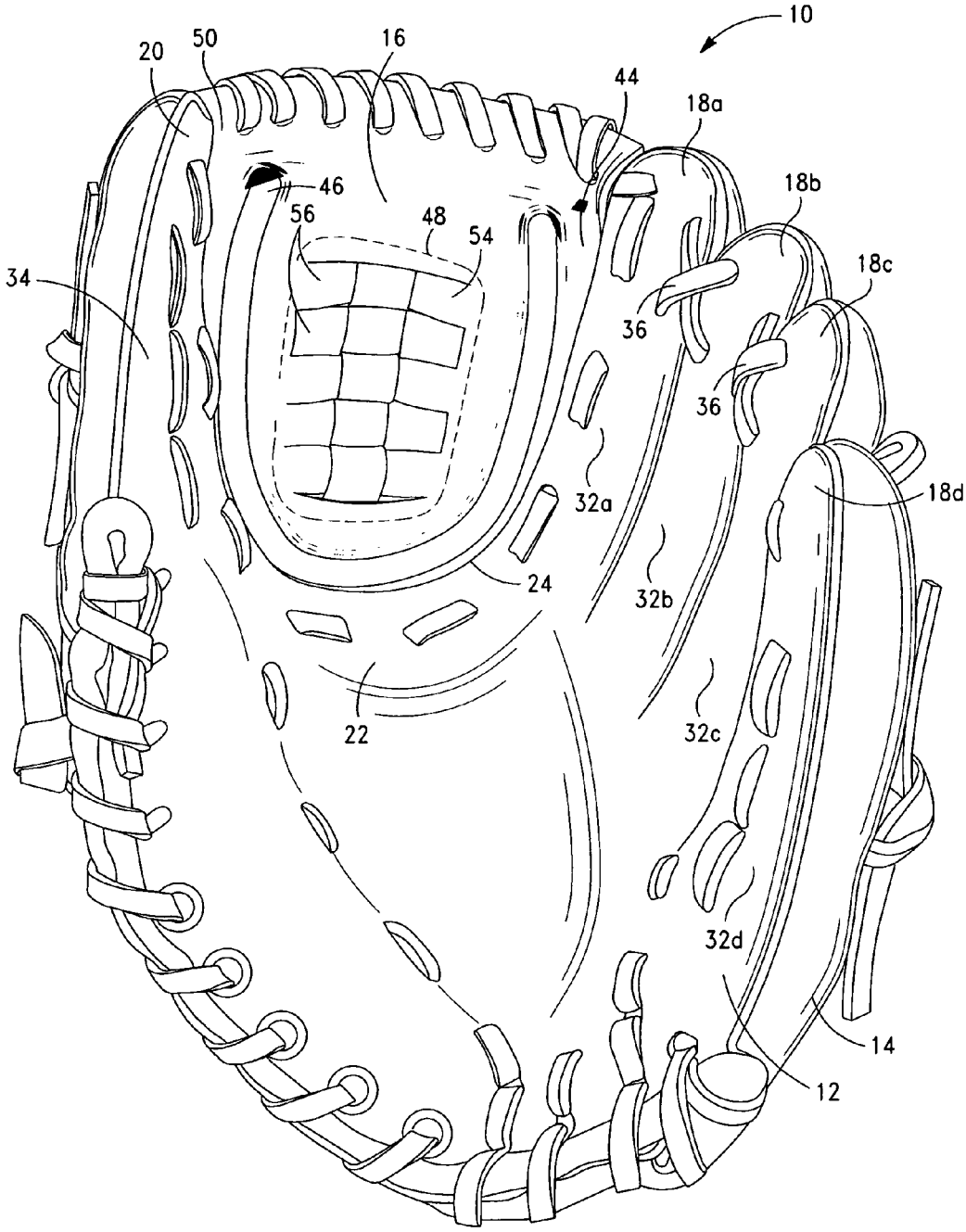
FIG. 1 is a front perspective view of a ball glove in accordance with an exemplary embodiment of the present invention.

Looking first to FIGS. 1 through 6, a lighted ball glove in accordance with an exemplary embodiment of the present invention is depicted generally by the numeral 10. As shown in FIG. 1, glove 10 includes a front portion 12 configured to cover the front or palm of a wearer's hand, a rear portion 14 configured to cover the rear or back of a wearer's hand, and a web portion 16 configured to receive a ball.

Glove

Figure 2:
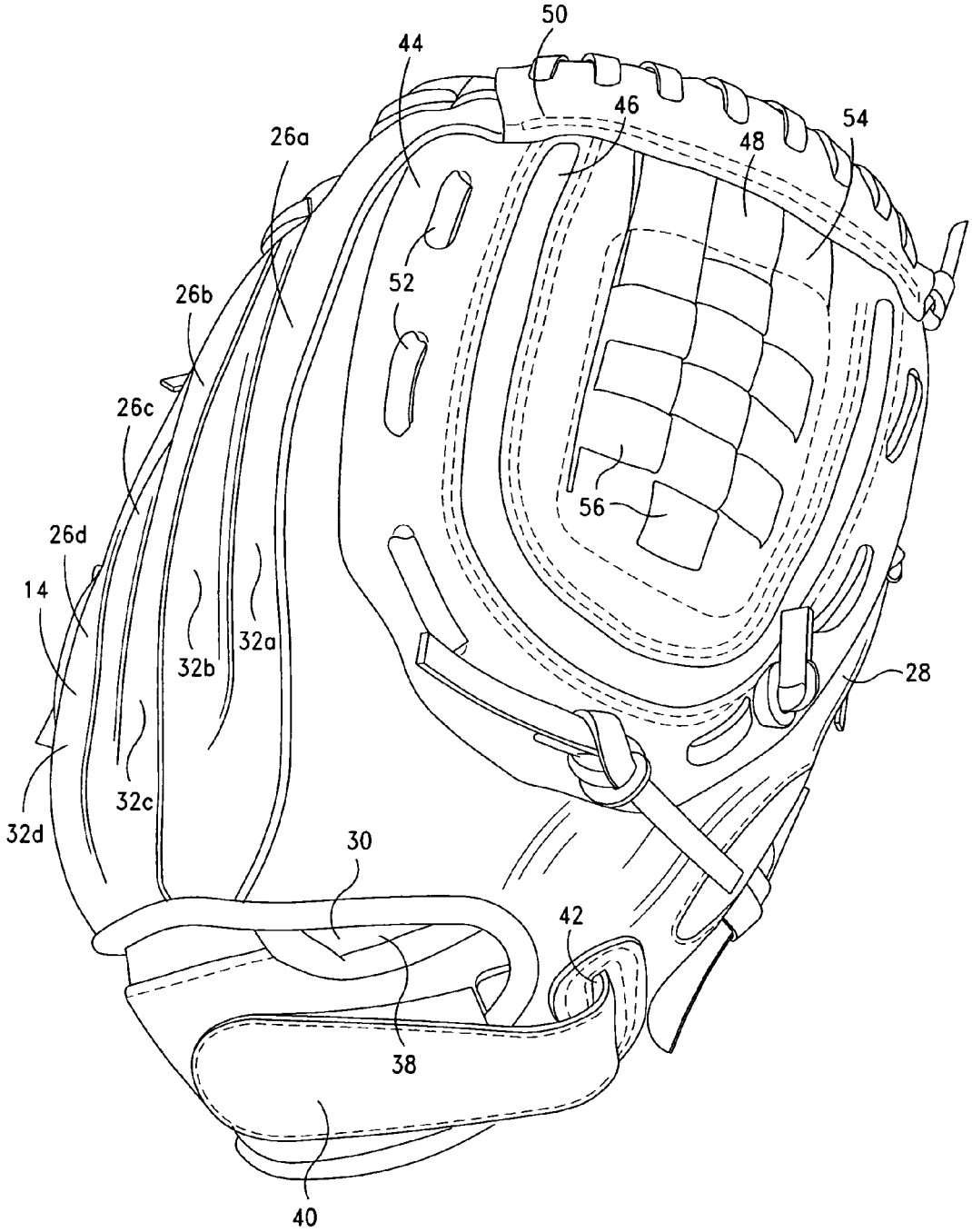
FIG. 2 is a rear perspective view of the ball glove of FIG. 1.

Looking still to FIG. 1, front portion 12 includes four finger portions 18*a*, 18*b*, 18*c*, 18*d*, corresponding to the index finger, middle finger, ring finger, and little finger, respectively, of the wearer, and a thumb portion 20 corresponding to the wearer's thumb. Palm portion 22 extends between the lower ends of the finger portions to the lower end of the thumb portion, and is configured to generally conform to and cover the palm of the wearer's hand. The transition between thumb portion 20 and index finger portion 32*a* defines a U-shaped area 24 in which web portion 16 is located, as discussed in more detail herein below. Turning now to FIG. 2, rear portion 14 corresponds generally to front portion 12, with four finger portions 26*a*, 26*b*, 26*c*, 26*d* and a thumb portion 28 aligned with the corresponding fingers and thumb of front portion 12.

Looking to FIGS. 1 and 2, front portion 12 is affixed to rear portion 14 around the outer perimeters of the finger and thumb portions of each, and along the U-shaped area 24 between the two, leaving an opening 30 at the bottom of the glove for placing the glove on the wearer's hand. Front portion 12 thus covers and provides protection to a wearer's palm, fingers, and thumb. With the portions thus joined, finger stalls 32*a*, 32*b*, 32*c*, 32*d* and thumb stall 34 are formed for receiving the fingers and thumb, respectively, of a wearer. Lacing 36 is used to join adjacent finger stalls, with additional lacing woven or laced into the palm, little finger, and web portions of the glove to provide additional cushioning and durability to the glove.

Front portion 12 and rear portion 14 are made from any strong, flexible material. Preferably, front portion 12 and rear portion 14 are made from a relatively thick material having some impact absorbing properties. Most preferably, front portion 12 and rear portion 14 are made of leather. Front portion 12 and rear portion 14 are affixed around their perimeters using stitching, although other methods known in the art, such as gluing, stapling, or riveting may be used without deviating from the scope of the present invention. Lacing 36 is preferably a thick, impact absorbing material, and is most preferably a leather strap. Other materials for front portion 12, rear portion 14, and lacing 36, and other methods of adhering front portion 12 to rear portion 14, will be apparent to those skilled in the art, and are within the scope of the present invention. In addition, other configurations of the glove will be apparent to those skilled in the art. For example, glove 10 need not have individual finger stalls for each of the wearer's fingers, the finger receiving portion may be formed as a single compartment or stall for receiving more than one, or all of, the wearer's fingers. This configuration is common in a first baseman's mitt, or a catcher's mitt. Either of these mitt configurations are within the scope of the present invention.

Looking now to FIG. 2, an inner liner portion 38, shaped substantially like front portion 12, is attached to the rear surface of front portion 12, with padding material located between front portion 12 and inner liner 38. Thus, the palm side of a wearer's hand inserted into the glove contacts inner liner 38, with the back side of the hand contacting rear portion 14. This configuration of front portion 12 and inner liner 38 allows padding or impact-absorbing material, such as foam rubber, neoprene, or other foamed elastomeric materials to be placed between the inner liner 38 and front portion 12 to further protect the wearer's hand.

Inner liner 38 is preferably made from a strong flexible material, and is most preferably made from leather. Preferably, inner liner 38 is stitched to front portion 12 around its perimeter, although any other methods known in the art, such as gluing or riveting, may also be used. Of course other configurations and variations will be apparent to those skilled in the art. For example, the padding material between front portion 12 and inner liner 38 may be additional layers of leather. Or, inner liner 38 may be made from a light-weight material, such as nylon. Similarly, additional liners or padding material may be used in other areas of the glove without deviating from the present invention. For example, a rear liner may be used to line rear portion 14, or padding material may be affixed to various portions of the glove.

Still looking to FIG. 2, an adjustment strap 40 extends across opening 30, and though slot 42, wrapping back on itself along opening 30. Adjustment strap 40 includes a hook and loop type fastener material to allow the strap to be affixed in place. Tightening adjustment strap 40 allows the wearer to secure the glove to their wrist to keep the glove from moving or falling. Of course, other types of adjustment mechanisms and securing means known in the art will be apparent to those skilled in the art, and may be used without deviating from the present invention.

Web

Looking to FIGS. 1 and 2, web portion 16 attaches to glove 10 in the U-shaped juncture 24 between thumb stall 34 and index finger stall 32*a*, filling the area defined between the two. Web 16 is comprised of an outer piece 44, shaped as a large "U", affixed at its outer perimeter to the rear portions of index finger stall 32*a* and thumb stall 34, and along the U-shaped area 24 of palm portion 22 between the two. A U-shaped translucent lens 46 is affixed at its own outer perimeter to the inner perimeter of outer piece 44, with an inner piece 48 further affixed to the inner perimeter of translucent lens 46. Web 16 thus covers the entire opening defined between thumb stall 34 and index finger stall 32*a*, providing a pocket for receiving and catching a ball in glove 10. An upper piece 50 wraps over a lace extending between thumb stall 34 and index finger stall 32*a,* and affixes to outer piece 44 and inner piece 48, providing an upper support for web 16.

As best seen in FIG. 2, outer piece 44 substantially overlaps the rear portion of index finger stall 32*a,* thumb stall 34, and the upper palm area 22 of rear portion 14. Outer piece 44 is affixed in place by stitching and gluing, with lacing 52 further securing outer piece 44 to rear portion 14. Outer piece 44 is made from a durable, strong material, most preferably leather. Translucent lens 46 is a U-shaped, flexible material, preferably a material having light-transmitting properties. Most preferably, translucent lens 46 is formed as a hollow tube, with a protruding lip around the length of the tube for attaching the lens to adjoining material, and is made from a translucent material. Most preferably, lens 46 is made of a plastic such as polystyrene. Translucent lens 46 is affixed around its outer perimeter to the inner perimeter of outer piece 44, preferably with stitching. Inner piece 48 is affixed with stitching to the inner perimeter of translucent lens 46. Inner piece 48 includes a woven portion 54 comprised of interlaced straps 56 extending across the center area of inner piece 48. Flexible straps 56 act to absorb impact from a caught ball, and also provide a decorative aspect to web 16.

Web 16 thus fills the U-shaped area 24 defined between index finger stall 32*a* and thumb stall 34, and provides a pocket for catching and holding a ball. As shown in FIGS. 1 and 2, U-shaped translucent lens 46 in web 16 is visible from both the front and rear of glove 10, allowing light-emitting devices embedded in the lens (as described in more detail herein below) to be observed from either the front or the rear of the glove.

Numerous other configurations and arrangements of web 16 will be apparent to those skilled in the art, and are within the scope of the present invention. For example, the entire web could be formed from a single piece of material. Or the woven pattern could extend across the entire web 16. Likewise, variations on translucent lens 46 are contemplated by the present invention. For example, the lens could be shaped in various geometric shapes, such as a star or square. Or the lens could be manufactured from a transparent, rather than a translucent material. These variations, and others apparent to those skilled in the art, are within the scope of the present invention.

Impact Sensor and Visual Signal

Figure 3:
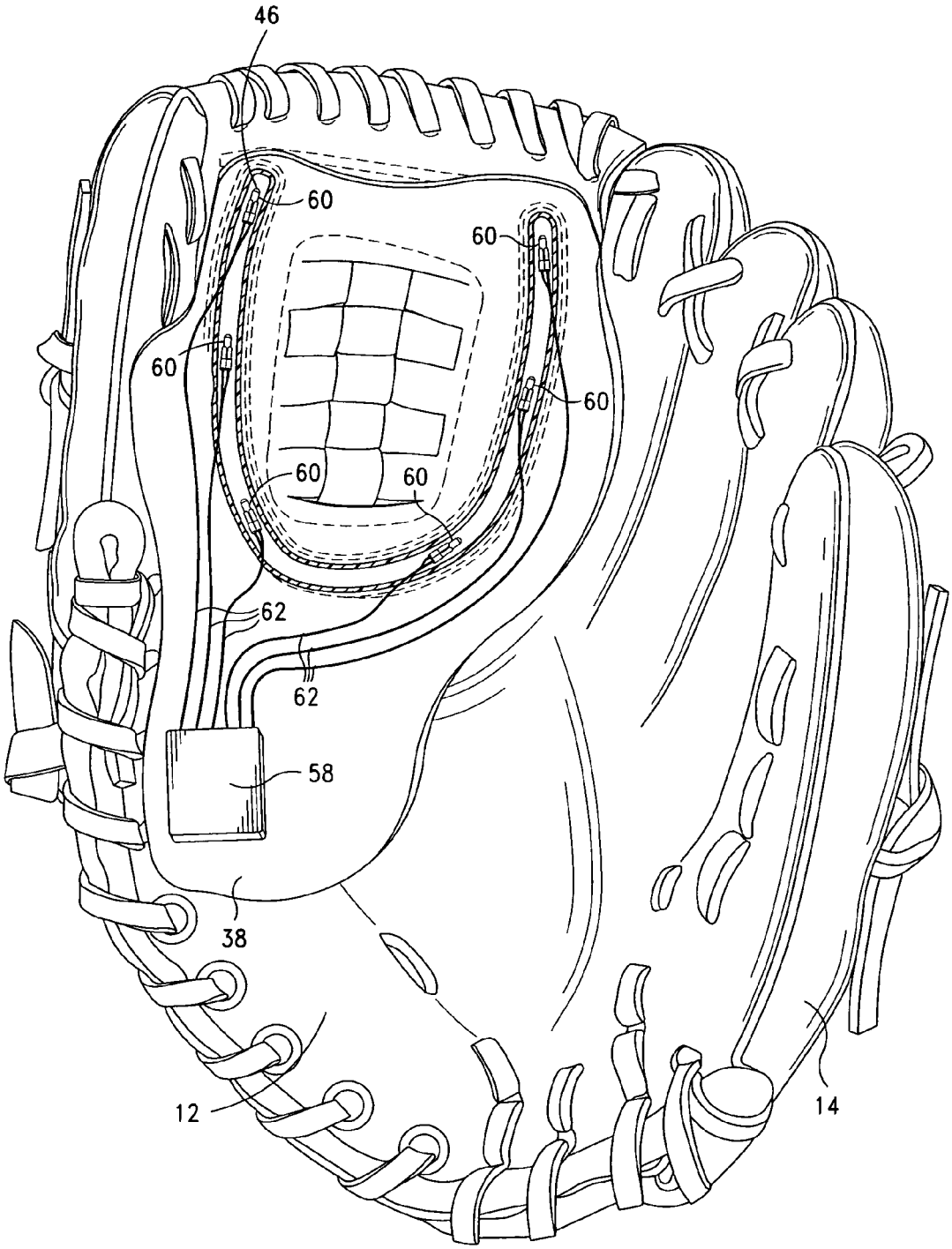
FIG. 3 is a cut-away view of the ball glove of FIG. 1, showing an electronic circuit module in the palm area of the glove and light-emitting diodes mounted in the web portion of the glove.

Turning now to FIG. 3, cutting away a portion of the glove of FIG. 1 shows an electronic module 58 embedded in glove 10, located between front portion 12 and inner liner 38 near the base of thumb stall 34. Electronic module 58 includes impact detection circuitry for detecting the impact of a ball hitting the glove, and annunciation circuitry for announcing detection of the impact via light-emitting diodes 60, which are embedded in translucent lens 46 at the web 16 of the glove. Wire pairs 62 attach each light emitting diode 60 to electronic module 58, with the module and wires being located in the space between front portion 12 and inner liner 38, placed in the padding between the two pieces.

Figure 4A:
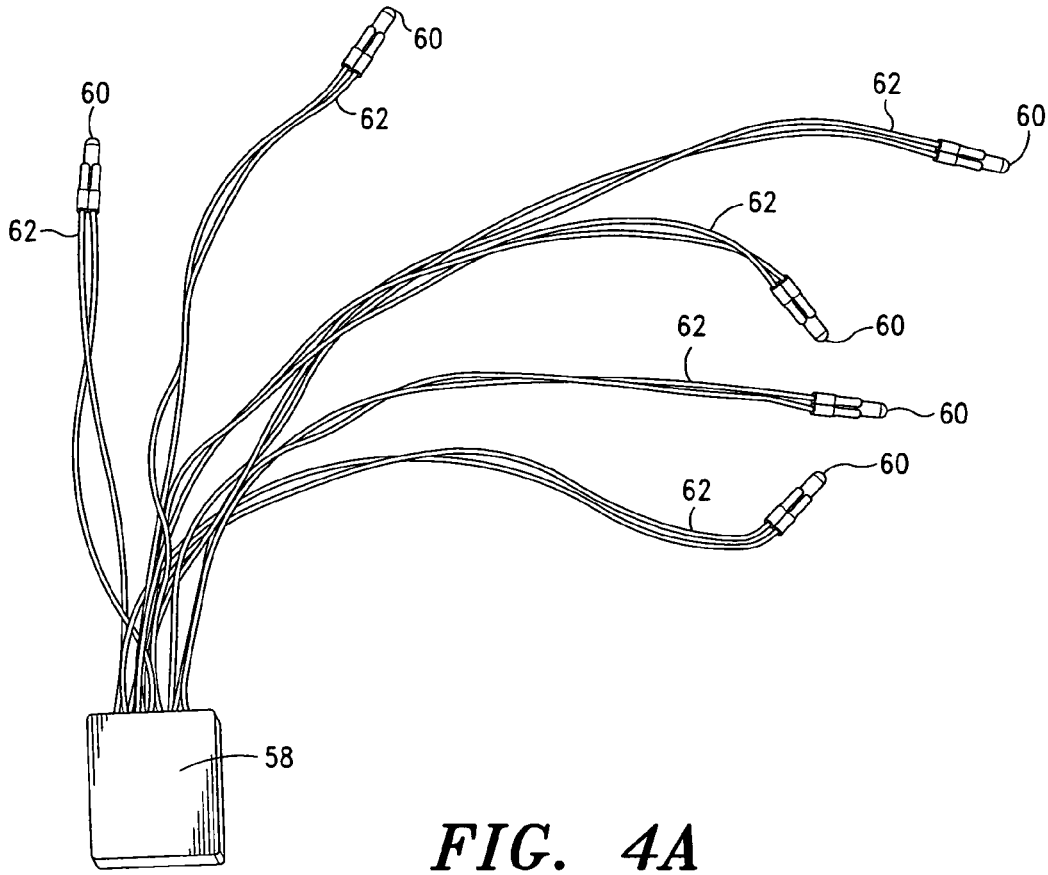
FIG. 4A is a plan view of the circuitry module and LEDs of the ball glove of FIG. 3.

As shown in FIG. 4A, electronic module 58 is a small, rectangular module, approximately 1 inch×1 inch×⅜ inch, encapsulating an inner circuit board comprising the impact detection circuitry, annunciation circuitry, and battery (described in more detail herein below) in a hard plastic epoxy resin. Six wire pairs 62 extend from module 58, each terminating at a light-emitting diode (LED) 60 at the end of the corresponding pair. Wire pairs 62 range in length from approximately four inches to approximately eight inches, but of course may vary depending upon the desired routing of the wires and the desired location of the LEDs on the glove. LEDs 60 are preferably low power, bright LEDs. Most preferably, they are super bright LEDs such as model number TD-V244SRC, manufactured by Leng Fa Plastic of China. While LEDs are one means for providing a visible annunciation signal, other light-emitting components and means may be used, and will be apparent to those skilled in the art.

Figure 4B:
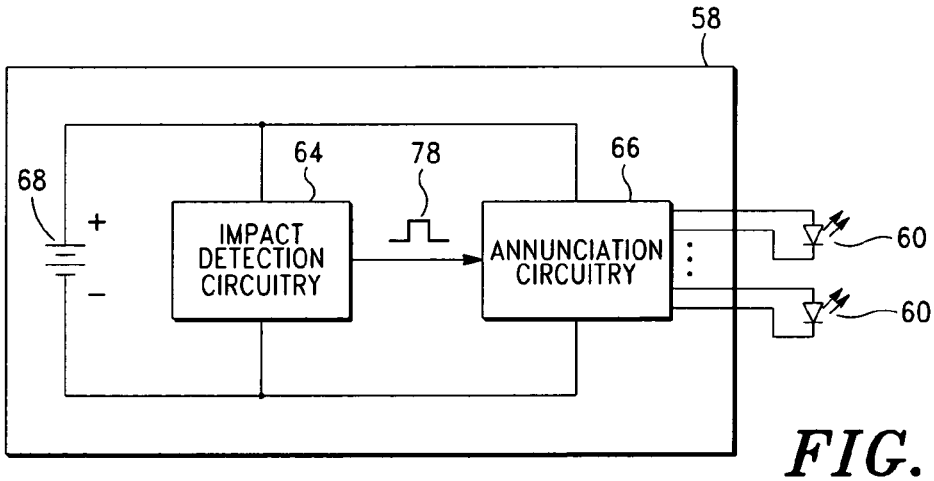
FIG. 4B is a block diagram schematic of the circuit of the module of FIG. 4A, and a schematic of the light-emitting diodes of FIG. 4A connected to the module.

Looking to FIG. 4B, electronic module 58 includes impact detection circuitry 64 for detecting an impact to the glove (such as the impact that occurs when catching a ball), annunciation circuitry 66 for announcing detection of the impact by sequentially flashing LEDs 60 in a predetermined pattern, and a battery 68 for powering the circuitry and LEDs.

Impact detection circuitry 64 includes an acceleration sensor for detecting an acceleration, in the form of an impact or vibration, to the glove. As used herein, the term "acceleration" encompasses both positive and negative accelerations (often called "deceleration"). The acceleration sensor is any acceleration-sensitive component capable of detecting vibration or impact that causes an acceleration above a predetermined threshold, and generating an output trigger signal indicating that an impact above that threshold level has been detected. Numerous types of accelerometers and acceleration-sensitive components are known in the art, and may be used for purposes of the present invention. Most preferably, the acceleration sensor is a momentary reed type switch.

Figure 4C:
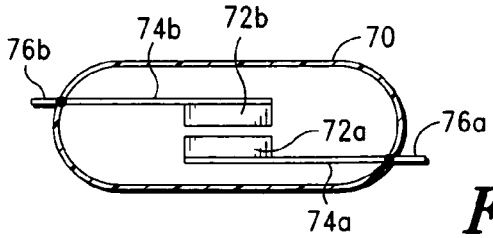
FIG. 4C is a schematic diagram of a momentary reed switch used as an acceleration sensor in the module of FIG. 4A.

As shown in FIG. 4C, a reed switch 70 comprises two electrical contacts 72*a,* 72*b,* each affixed to the end of a suspended arm or reed 74*a,* 74*b.* The mass of the contacts, the mass of each reed, the stiffness of each reed, and the distance between the contacts determines the inertial and acceleration-responsive properties of the momentary switch. An impact, vibration, or other acceleration of the switch causes the reeds to flex, allowing the two contacts to momentarily touch, thus completing a circuit to generate a trigger signal. For instance, very flexible reeds located in close proximity would be responsive to low-level accelerations as the reeds would flex (and the contacts would thus momentarily touch) in response to those low level accelerations. By contrast, very stiff reeds, located relatively far apart, would not be responsive to low-level accelerations, as the low-level changes would not flex the reeds enough to allow the contacts to touch.

Furthermore, the orientation of the reeds within the electronic module, and the placement of the module on the equipment, also affects the sensitivity of the reed switch to various levels and directions of acceleration. For example, looking to the reeds of the switch shown in FIG. 4C, an acceleration perpendicular to the reeds would be more easily detected than an acceleration in a direction lateral or planar to the reeds. Thus, different orientations and positioning of the reed switch (and thus the electronic module) allow the switch to be adjusted to vary the detection threshold of the switch in a particular direction. When an impact above that threshold acceleration occurs, contacts 72*a,* 72*b* of the switch touch each other to complete the circuit between input and output connections 76*a,* 76*b* on the switch. For example, mounting the electronic module in the area of the palm of the glove exposes the electronic module and momentary reed switch directly to the area where a ball will be caught in the glove, thus allowing the detection of even relatively minor impacts. However, moving the electronic module and momentary reed switch to a location further from the area of the glove directly impacted by the ball, such as on the rear of the glove, would isolate the momentary switch from minor impacts. In that location, only a significant impact to the glove would result in the impact being detected by the momentary reed switch. Thus, it can be seen that the location of the momentary reed switch on the glove can be used to adjust the sensitivity of the reed switch, or to adjust the threshold acceleration level at which the switch will complete the circuit.

While a reed switch provides one means for detecting acceleration, other means and configurations of acceleration sensitive components will be apparent to those skilled in the art. For example, a reed switch comprising a single reed supporting a single contact, with the second contact being in a fixed position on the switch enclosure, may be used. Other configurations of momentary switches may be used. For example a sensor comprising a contact affixed to a spring, surrounded by a metal container that serves as a second contact may be used. When the spring is jolted from its position by an impact, the contact on the spring touches the metal enclosure, thus completing the circuit. Similarly a pendulum type sensor, comprising an arm suspended within a ring or enclosure, may be used. An impact to the pendulum arm causes it to move and contact the ring or enclosure containing it, thus completing the circuit. These, and other variations of acceleration-sensitive components and sensors, or other types of acceleration detecting components or circuitry, such as accelerometers, will be known to those skilled din the art, and are within the scope of the present invention.

Looking back to FIG. 4B, upon occurrence of an impact causing the contacts of the momentary reed switch to touch as just described, a trigger signal 78 is output from impact detection circuitry 64 to annunciation circuitry 66. Trigger signal 78 may be a voltage level passed directly through the acceleration sensor, or may be a conditioned signal produced by a one-shot multivibrator type circuit, as is known in the art. Numerous variations on the generated trigger signal will be apparent to those skilled in the art, and are within the scope of the present invention so long as the trigger signal indicates detection of an impact, and is recognizable by the annunciation circuitry. For example, the polarity of the trigger signal may be inverted, and the signal may be conditioned through debouncing circuitry. These and other variations will be known to those skilled in the art.

Looking still to FIG. 4B, upon detection of trigger signal 78, annunciation circuitry 66 initiates the activation of LEDs 60 in a predetermined pattern of a predetermined duration. Preferably, the predetermined pattern sequentially activates the LEDs, in series, four times in approximately 1.5 seconds. Various configurations of circuitry capable of detecting the trigger signal and generating the oscillator and drive signals necessary to implement the annunciation circuitry and achieve the desired activation pattern may be used. Preferably, annunciation circuitry is an application specific integrated circuit (ASIC). Of course, other configurations and variations on the annunciation circuitry will be apparent to those skilled in the art. For example, the annunciation circuitry may be configured from discrete components such as transistors, or combinations of discrete components and various integrated circuits such as 555 series timer circuits and the like. These, and other configurations, will be apparent to those skilled in the art, and are within the scope of the present invention. Similarly, the specific annunciation circuitry may be varied without deviating from the present invention. For example, the pattern of the LEDs may be varied to flash all LEDs simultaneously, or may be varied to flash the LEDs in other than a sequential pattern. These and other variations are contemplated by the present invention.

As shown in FIG. 4B, battery 68 is used to provide power to impact detection circuitry 64, annunciation circuitry 66, and LEDs 60. Battery 68 is preferably a high-power, low profile battery capable of providing power for numerous iterations of triggering annunciation circuitry 66 and lighting LEDs 60. Most preferably, battery 68 is a lithium dioxide battery.

Operation

Figure 5:
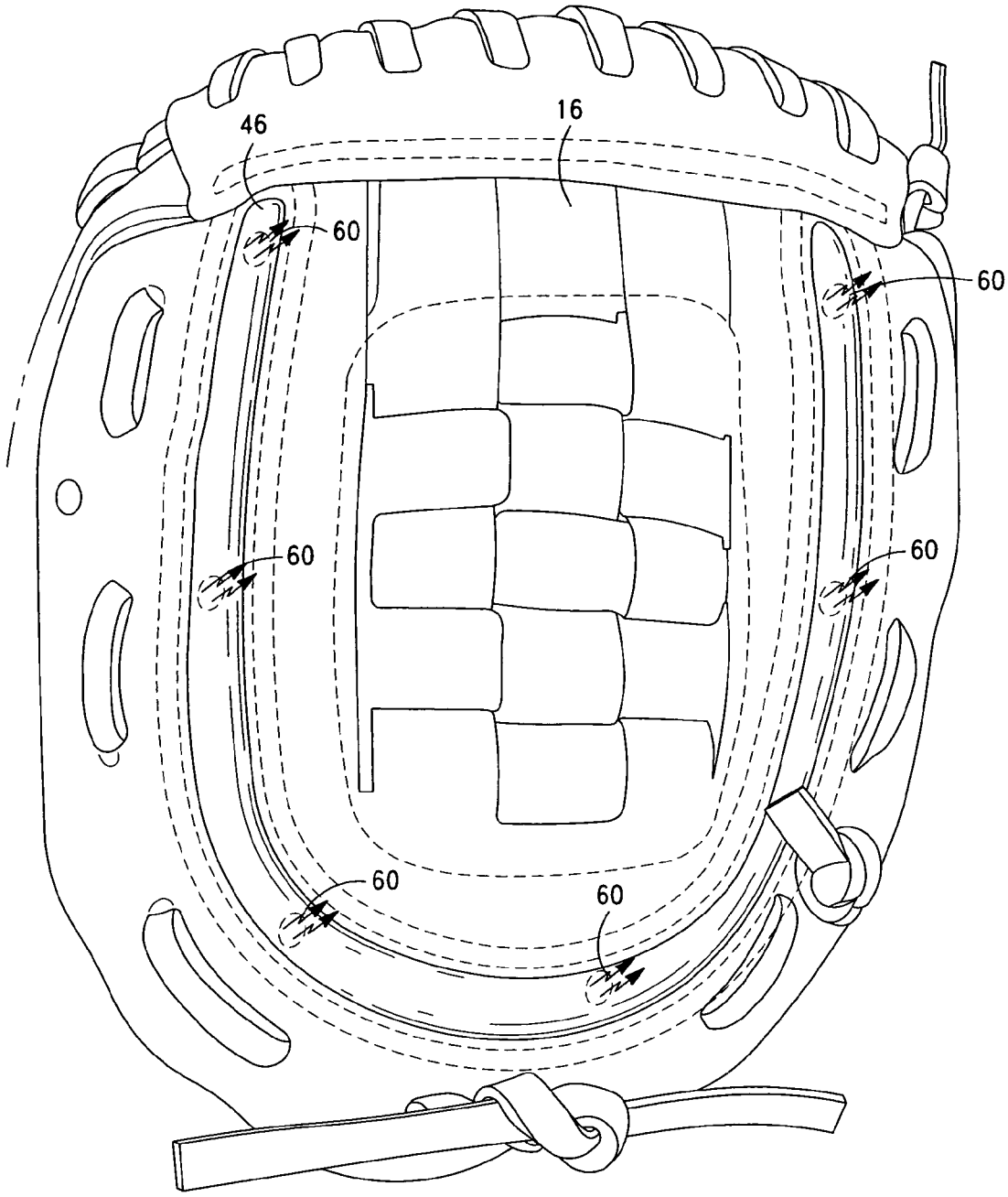
FIG. 5 is a close-up, partial rear view of the web portion of the glove of FIG. 1, showing light emanating from the LEDs in the translucent lens on the web portion of the glove.
Figure 6:
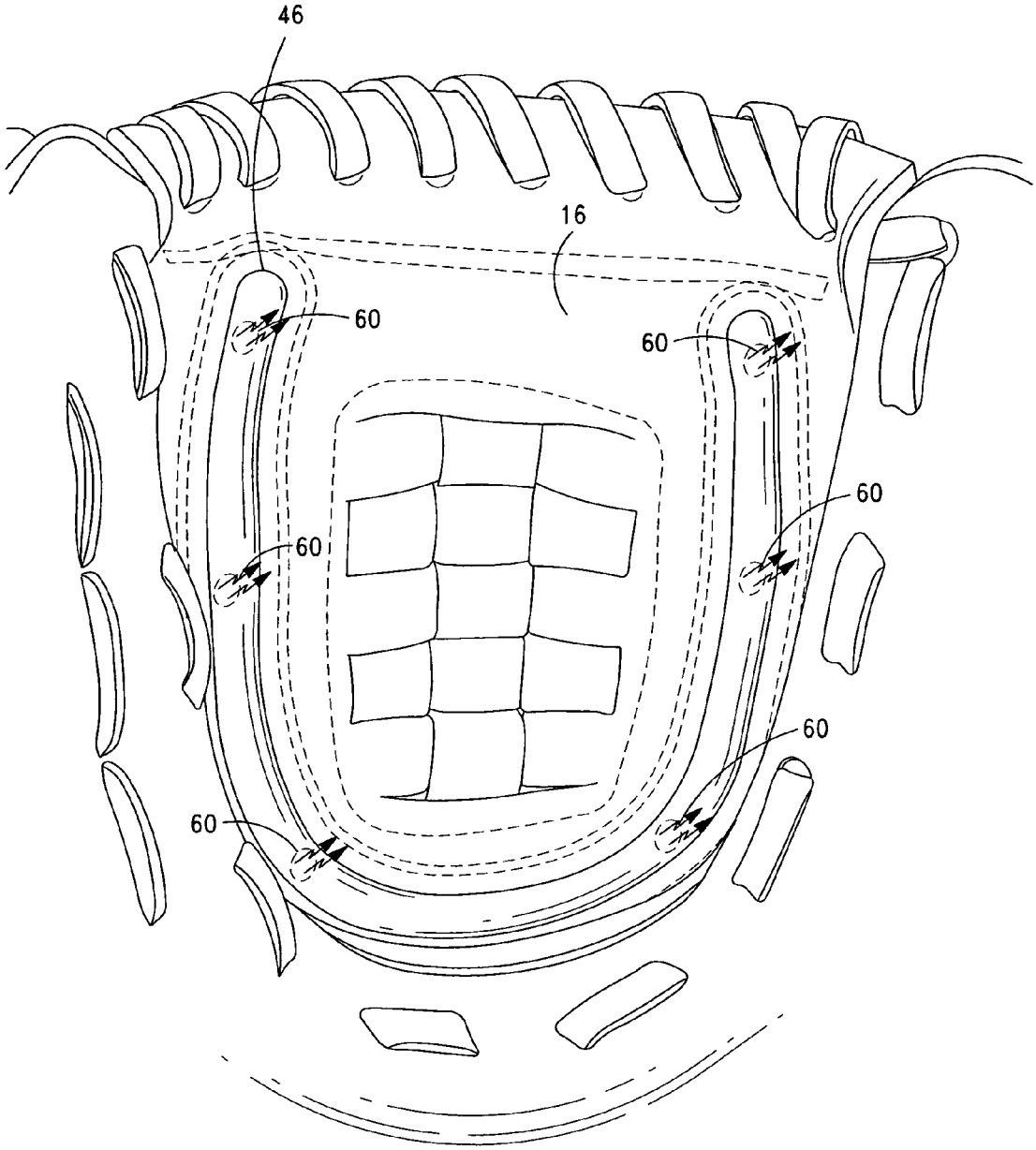
FIG. 6 is a close-up, partial front view of the web portion of the glove of FIG. 1, showing light emanating from the LEDs in the translucent lens on the web portion of the glove.

Looking now to FIGS. 5 and 6, in operation LEDs 60 are embedded in translucent lens 46, located in a symmetrical pattern along the length of the lens 46. Upon detection of an impact by impact detection circuitry 64, LEDs 60 are sequentially activated according to the pattern previously described. As seen in FIG. 5, the lighted LEDs 60 are visible from the rear of the glove through translucent lens 46 in web portion 16. Likewise, as seen in FIG. 6, the lighted LEDs 60 are also visible from the front of the glove, through translucent lens 46 in web portion 16.

Thus, a detected impact, such as that generated by catching a ball, triggers a light display in the translucent lens located in the web of the glove. The light display is visible from both the front and rear of the glove, and is thus visible to both the player and spectators.

Other variations to the configuration shown will be apparent to those skilled in the art, and are within the scope of the present invention. For example, the LEDs may be flashed in different patterns than described. Or, the translucent lens may be shaped differently, or located in a different area of the glove. Likewise, the LEDs may be located individually, with or without a translucent lens, for example at each fingertip of the glove. Means of visible, light-emitting annunciation other than light-emitting diodes may also be used, such as light bulbs, neon lights, and the like. Furthermore, the impact sensor may trigger the lights or other visual annunciation means via a wireless communication instead of via electrical communication. These and other variations are contemplated by, and are within the scope of, the present invention.

As can be seen, the invention described herein provides ball gloves that provide impact detection and annunciation. The invention allows players and observers to visually verify an impact event, such as catching a ball in the glove. Of course, other embodiments or configurations will be apparent to those skilled in the art, and are contemplated by and within the scope of the present invention.

The term "substantially" or "approximately" as used herein may be applied to modify any quantitative representation which could permissibly vary without resulting in a change in the basic function to which it is related. For example, the outer portion of the web is described as substantially overlapping the index finger stall and thumb stall, but may permissibly vary from that configuration if the variance does not materially alter the capability of the invention.

While the present invention has been described and illustrated hereinabove with reference to various an exemplary embodiment, it should be understood that various modifications could be made to the embodiment without departing from the scope of the invention. Therefore, the invention is not to be limited to the exemplary embodiment described and illustrated hereinabove, except insofar as such limitations are included in the following claims.

What is claimed and desired to be secured by Letters Patent is as follows:

1. A lighted ball glove, comprising:

a glove configured to receive a wearer's hand, said glove comprising a front portion and a rear portion configured to conform to a palm side and a rear side of a wearer's hand, respectively, said rear portion affixed to said front portion to define a thumb stall and a finger stall therebetween with a web portion affixed between said thumb and finger stalls;

a translucent lens positioned along a perimeter of said web portion;

impact detection circuitry affixed to said glove, operable to detect an impact to said glove portion; and light-emitting circuitry in communication with said impact detection circuitry and operable to provide a visual indication of detection of said impact, said light-emitting circuitry comprising at least one light-emitting diode positioned behind said translucent lens.

2. The lighted ball glove of claim 1, wherein said translucent lens comprises a flexible tube, and wherein said at least one light-emitting diode is positioned within said tube such that light emanating from said light-emitting diode is visible from both a front and a rear of said web portion.

3. The lighted ball glove of claim 1, wherein said impact detection circuitry is affixed between said front portion and said rear portion of said glove.

4. The lighted ball glove of claim 3, wherein said impact detection circuitry is located in an area of said glove corresponding to a palm of said wearer.

5. The lighted ball glove of claim 1, wherein said light-emitting circuitry comprises a plurality of light-emitting diodes configured to activate in a predetermined sequence.

6. The lighted ball glove of claim 5, wherein said light-emitting circuitry is configured to sequentially activate said light emitting diodes in a predetermined sequence for a predetermined amount of time after detection of said impact.

7. A lighted ball glove comprising:

a glove configured to receive a wearer's hand, said glove comprising a front portion, a rear portion, and a web portion, said web portion comprising a translucent member;

impact detection circuitry affixed to said glove and operable to detect an impact to said glove; and light-emitting circuitry in communication with said impact detection circuitry and operable to provide a visual indication of detection of said impact, said light-emitting circuitry comprising a plurality of light-emitting diodes affixed to said translucent member wherein said translucent member is configured such that light emanating from said light-emitting diodes is visible from both a front and a rear of said glove.

8. The lighted ball glove of claim 7, wherein said light-emitting circuitry is configured to activate said light-emitting diodes in a predetermined sequence.

9. The lighted ball glove of claim 7, wherein said impact detection circuitry comprises an acceleration sensor.

10. The lighted ball glove of claim 9, wherein said acceleration sensor is configured to detect an acceleration rate exceeding a predetermined threshold.

11. The ball glove of claim 9, wherein said acceleration-sensor is a momentary switch.

12. The ball glove of claim 11, wherein said momentary switch is a reed switch operable to complete an electrical circuit to said light-emitting circuitry.

* * * * *